United States Patent [19]

McCay

[11] 4,074,464

[45] Feb. 21, 1978

[54] ADJUSTABLE THRESHOLD

[76] Inventor: Dariel McCay, P.O. Box 649, Lexington, Tenn. 38151

[21] Appl. No.: 729,859

[22] Filed: Oct. 4, 1976

[51] Int. Cl.[2] ..... E06B 1/70

[52] U.S. Cl. ..... 49/468; 49/469

[58] Field of Search ..... 49/467–470

[56] References Cited

U.S. PATENT DOCUMENTS

| | | | |
|---|---|---|---|
| 2,849,763 | 9/1958 | Leigh | 49/469 |
| 2,947,043 | 8/1960 | Klemma | 49/468 |
| 3,114,180 | 12/1963 | Riedl | 49/468 |
| 3,374,579 | 3/1968 | Neff | 49/468 |
| 3,762,100 | 10/1973 | Kempel | 49/468 |

*Primary Examiner*—Philip C. Kannan
*Attorney, Agent, or Firm*—I. C. Waddey, Jr.

[57] ABSTRACT

This invention relates to an improvement for adjustable thresholds. The invention includes a threshold base having a channel extending through the length of the base. Sitting in the channel of the base is an elongated bar having an inverted U-shape cross-section. Throughout the length of the bar are several holes extending through the base of the U-shaped section. Several of these holes are threaded and a bolt is screwed into the threaded hole with the head of the bolt sitting on the bottom of the channel in the base. Screwing the bolt into and out of the threaded hole in the bar will raise and lower the bar, and once the height of the bar has been adjusted, it is fixed in the base of the threshold by a screw extending through holes in the bottom of the inverted U-shaped bar and screwed into threaded holes in the bottom of the channel of the base. Longitudinally extending grooves are formed in the base of the inverted U-shaped bar and an elongated rubber cover fits over the threshold with elongated protrusions fitting into the slots of the bar. The end flanges of the elongated cover are biased downward to fit snugly against the sloped edges of the base of the threshold to cause the elongated cover to snugly fit over the threshold and to keep the entire unit clean and prevent persons from tripping over the threshold.

5 Claims, 5 Drawing Figures

ADJUSTABLE THRESHOLD

My invention relates to adjustable thresholds to accommodate doors that may be cut unevenly across the bottom or that may jam or have unnecessary clearance over the threshold as a result of settling of structures.

Adjustable thresholds are known to the prior art and the purposes of inventions of this nature are well documented. However, the adjustable thresholds of the prior art are oftentimes complicated structures which may actually constitute a safety hazard because of the nature of their structure. Moreover, they are complicated and expensive to manufacture, and they are often difficult to adjust and easily knocked out of adjustment.

It is the object of the present invention to overcome the aforesaid disadvantages of the prior art, and in particular, it is an object of this invention to provide an adjustable threshold which when set in place, can be easily adjusted and yet secured so that it cannot be struck and knocked out of adjustment.

Other objectives of the invention will become apparent from a review of the detailed description of the invention as set forth in the specification hereinafter and by reference to the accompanying drawings wherein.

Figure 1:
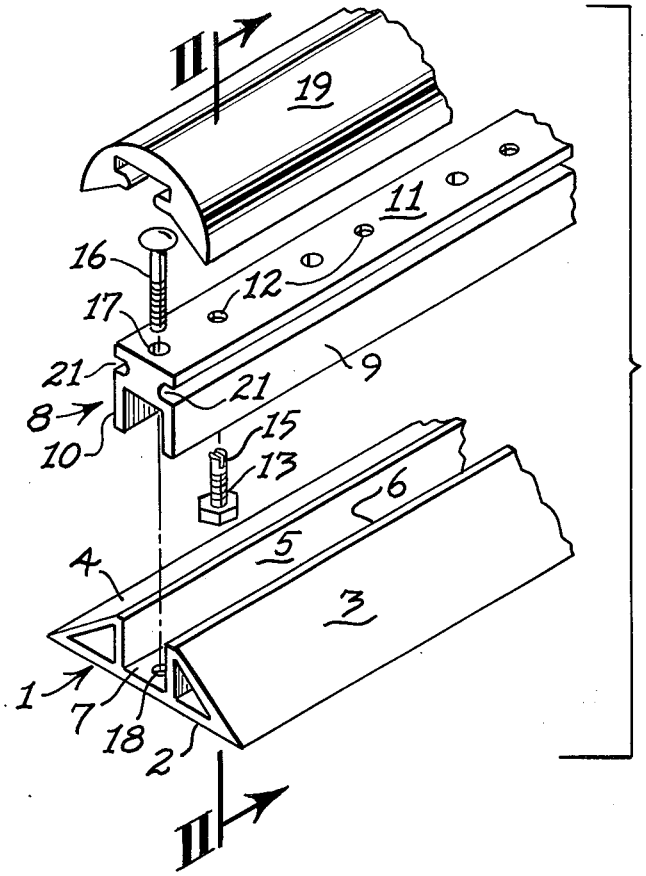
FIG. 1 is an effective view of one embodiment of the invention shown in exploded arrangement.

Referring to FIG. 1 of the drawings, a preferred embodiment of the adjustable threshold of my invention is illustrated. The threshold in FIG. 1 is shown in exploded relation. The base 1 of the threshold is an elongated structure having a flat bottom 2, sloping sides 3 and 4 and parallel vertical walls 5 and 6. The bottom 2 and walls 5 and 6 of the base form an elongated channel 7 extending through the length of the base 1.

Figure 3:
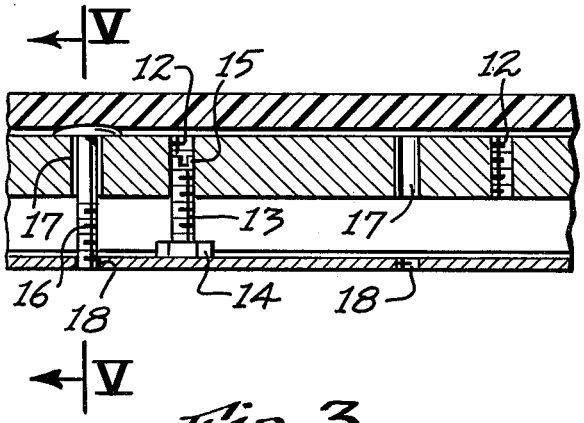
FIG. 3 is a view taken along the line III—III in FIG. 2.

Seated within the channel 7 of the base is an elongated bar 8 which, in cross-section, is an inverted U-shaped member. The bar 8 has vertically depending legs 9 and 10, and a stepplate 11. The bar 8 has holes 12 extending through the stepplate 11. The holes 12 are internally threaded as can be seen from FIGS. 3 and 4, and screwed into the holes 12 is a bolt 13 having a flat head 14.

When the adjustable threshold is assembled, the head 14 of the bolt 13 sits on the upper surface of the bottom 2 of the base of the threshold. A groove 15 is cut in the upper end of the bolt 13 and when the adjustable threshold is assembled, the height of the bar 8 may be adjusted by inserting a screwdriver through the holes 12 into the slot 15 of the bolt 13 and turning the bolt 13 so as to screw it into or out of the threaded hole 12.

Figure 5:
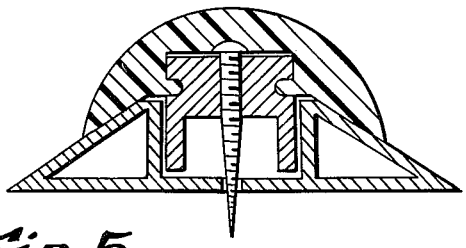

Once the height of the bar 8 has been adjusted to conform to the bottom surface of a door which would close onto the threshold, the position of the threshold is secured by screws 16 extending through holes 17 in the bar. The screw is threaded into threaded holes 18 formed in the bottom 2 of the base 1. Alternatively, the screws may be tapered wooden screws and tap into the wooden floor on which the threshold sits and thus eliminate the need to have a threaded hole 18 in the bottom of the base as is illustrated in FIG. 5. This alternative structure has the advantage of securely holding the entire threshold in place on the floor.

After the entire assembly has been adjusted, the elongated cover 19 is pressed onto the bar 8 to cover the entire length of the threshold. The cover 19 is constructed of a heavy-duty flexible rubber material and is secured onto the base 8 by elongated protrusions 20 which fit into the elongated grooves formed in the length of the sides of the step-plate 11 of the bar 8.

Figure 4:
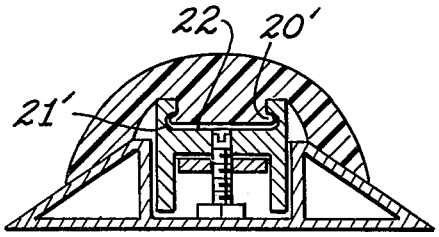
FIG. 4 is a view similar to the view shown in FIG. 2 showing a modified form of the invention, and, FIG. 5 illustrates a modification of the invention.

A modification of the connection between the cover 19 and the step-plate 11 is shown in FIG. 4. In that figure, it is seen that the elongated grooves 21′ are formed in the step-plate on the inner surface of a channel 22 formed in the upper surface of the step-plate. In the modification of FIG. 4, the elongated protrusions 20′ on the cover 19 protrude outwardly away from each other into the openings 21′ which face each other in the upper surface of the step-plate 11.

The cover 19 is crescent-shaped and is molded in such fashion that the outer surface of the cover is concaved in shape, and the legs 23 of the cover 19 are biased inwardly toward each other so that when the cover is in place, the legs 23 fit snugly onto the sloping sides 3 and 4 of the base of the adjustable threshold. The legs are pointed or V-shaped, as a result of the juncture of the convexed outer surface and concaved inner surface of the cover.

In operation, the adjustable threshold of my invention is installed by securing the base 1 to the floor of a building at a doorway or other opening. The bar 8 is then placed into the channel 7, and the bolt 13 is screwed into or out of the holes 12 in order to adjust the height of the step-plate to conform to the shape of the bottom of a door fitting over the threshold. The bar 8 is formed of a material and having a thickness so that when adjusted, it may flex along its length to conform to the desired shape. Once the bar is adjusted, it is secured in place and in the proper shape by inserting the screws 16 through the opening 17 and tightening them down into the threaded openings 18 in the bottom of the base 1. There are several bolts 13 and screws 16 extending along the length of the bar 8 in order to adjust the shape of the bar along its full length.

Figure 2:
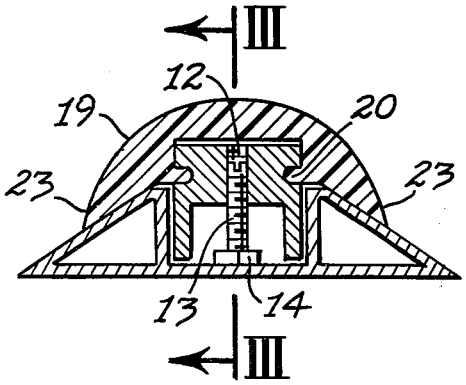
FIG. 2 is a view taken along the line II—II in FIG. 1.

Once the assembly is securely in place and properly adjusted, the cover 19 is placed over the threshold by pressing it onto the step-plate 11 and forcing the flexible cover over the step-plate so that the protrusions 20 are forced into the openings 21. The legs 23 of the cover 19 are then adjusted so that they fit smoothly onto the sloping sides 3 and 4 as can be seen from FIGS. 2 and 4. The legs 23 are essentially V-shaped so that when in place, the cover 19 makes a smooth transition from the base of the threshold to the cover thereby preventing persons stepping over the threshold from tripping on an uneven threshold. The fit of the cover over the threshold also assures that trash will not be swept into or otherwise lodged into the adjustment mechanism of the threshold so that the threshold can easily be readjusted upon the settling of the structure which might otherwise cause a jamming of the door against the threshold.

Having fully described a preferred embodiment of my invention, I claim:

1. An adjustable threshold including:

a. an elongated base having a bottom, holes in the bottom, sloping sides, and vertical walls, the vertical walls and bottom of the base forming a channel extending through the length of the base and the sloping sides connecting the upper surfaces of the vertical walls and the outer edges of the bottom;

b. an elongated bar positioned in the channel and having an inverted U-shaped cross-section formed by depending legs connected on their upper surface by an elongated step-plate, having a horizontal upper surface, the step-plate having elongated grooves along its length and holes having their axis perpendicular to the upper surface of the step-plate with at least two of said holes internally threaded;

c. bolts screwed into the threaded holes in the step-plate with the head of the bolts resting on the bottom of the base;

d. screws passing through holes in the step-plate and the holes in the bottom of the base, and e. an elongated cover constructed of flexible rubber material and having a crescent-shaped cross-section with a convex outer surface and concave inner surface, depending legs having V-shaped outer ends biased toward each other and elongated protrusions along the length of the concave inner surface, with the cover fitted over the base and bar, and its protrusions fitting within the grooves of the step-plate.

2. An adjustable threshold as set forth in claim 1 wherein the elongated grooves in the step-plate are inwardly extending grooves in the outer surface of the opposing vertical sides of the bar and the elongated protrusions of the elongated cover are inwardly extending protrusions on the inner concave surface of the cover.

3. An adjustable threshold as set forth in claim 1 wherein the elongated grooves in the step-plate extend outwardly from a channel in the upper surface of the step-plate and the protrusions of the flexible cover extend outwardly from the inner concave surface of the cover.

4. An adjustable threshold as set forth in claim 1 wherein the screws passing through the holes in the step-plate and the holes in the bottom of the base are tapered wood screws adapted to screw into the floor on which the adjustable threshold sits.

5. An adjustable threshold as set forth in claim 1 wherein the holes in the bottom of the base are internally threaded and the screws passing through the holes in the step-plate are threaded and screw into the threaded hole in the base.

* * * * *